United States Patent [19]

Dieffenbach et al.

[11] 4,101,697

[45] Jul. 18, 1978

[54] CONE LIKE SHEET FOR CHRISTMAS TREE

[75] Inventors: Percy Dieffenbach, Moscow, Pa.; Louis Zon, Clarence, N.Y.

[73] Assignee: American Technical Industries, Inc., Mount Vernon, N.Y.

[21] Appl. No.: 659,772

[22] Filed: Feb. 20, 1976

[51] Int. Cl.[2] ..... A47G 33/06

[52] U.S. Cl. ..... 428/9; 428/20

[58] Field of Search ..... 428/8, 9, 17, 7, 18, 428/19, 20; 211/197; 240/108 R, 10 T, 10 Q; 156/61

[56] References Cited

U.S. PATENT DOCUMENTS

| | | | |
|---|---|---|---|
| 1,590,220 | 6/1926 | Wurts | 428/20 X |
| 1,606,535 | 11/1926 | Hojnowski | 428/8 |
| 1,907,769 | 5/1933 | Favreau | 428/19 |
| 2,714,156 | 7/1955 | Robertshaw | 240/108 R |
| 2,975,270 | 3/1961 | Mayon | 240/108 R |
| 3,296,430 | 1/1967 | Eckert | 240/10 Q |
| 3,594,260 | 7/1971 | Dieffenbach | 428/20 |
| 3,676,275 | 7/1972 | Sloane | 428/19 X |
| 3,811,991 | 5/1974 | Dieffenbach | 428/9 |
| 3,819,457 | 6/1974 | Mottel | 428/9 |
| 3,928,712 | 12/1975 | Sears | 428/17 X |

*Primary Examiner*—George F. Lesmes
*Assistant Examiner*—Henry F. Epstein
*Attorney, Agent, or Firm*—Hopgood, Calimafde, Kalil, Blaustein and Lieberman

[57] ABSTRACT

An artificial tree includes a vertical trunk and a number of elongated limb assemblies mounted about the circumference of the trunk so that the limb assemblies extend downwardly along and outwardly from the trunk to define a truncated cone. A frusto conical member is mounted within the truncated cone defined by the branch assembly to provide a background for the branch assemblies and to create the appearance of a thicker, fuller artificial tree.

2 Claims, 5 Drawing Figures

CONE LIKE SHEET FOR CHRISTMAS TREE

BACKGROUND OF THE INVENTION

This invention relates to artificial shrubbery and more particularly to means for giving said shrubbery a fuller and more plesing appearance.

Artificial shrubbery and particularly artifical trees have recently gained in popularity and are now increasingly used for indoor and outdoor decoration. Such trees are often made of fireproof materials which make them especially desirable for use as indoor Christmas trees.

One such artificial tree comprising limbs of twisted wire and bristle is disclosed in U.S. Pat. No. 3,594,260 which issued to the present applicant and is entitled "Artificial Shrubbery and Method of Manufacturing the Same." One embodiment of the artificial tree construction of this patent utilizes a central trunk and a plurality of limb assemblies circumferentially arranged about the trunk. Each of the limb assemblies includes a main limb of twisted wire and bristle having a hooked end which is free of bristle and a number of smaller cross branches of twisted wire and bristle which extend outwardly in a substantially transverse direction from the main limb. The hooked ends of the limb assemblies extend through apertures in a holder which is circumferentially mounted about the central trunk at a point near the top. The limb assemblies hang downwardly from the holder and outwardly at an angle from the trunk to form a truncated conical configuration which provides the appearance of a well-shaped natural tree. In this type artificial tree construction, no branches are attached to the tree trunk within the truncated conical region defined by the limb assemblies. Artificial trees of this type include relatively few separate parts and can therefore be quickly and easily assembled to provide a completed tree. Such trees can also be easily disassembled for convenient storage.

In order to make artificial trees of this type commercially acceptable, they must appear thick and full. As in nature such a thick, full appearance can be achieved by the use of more branches. For this purpose additional branch assemblies can be provided but adding more branch assemblies to the tree makes the tree more difficult to assemble and disassemble and less easy to store. If more branches are added to each assembly, the tree will appear fuller but the individual branch assemblies will become undesirably heavy and bulky. The addition of more branches and/or branch assemblies will also increase the cost of the completed tree.

SUMMARY OF THE INVENTION

An artificial tree includes a vertical cylindrical trunk member having a central axis and a number of elongated limb assemblies. Means are provided for attaching the branch assemblies to the trunk member in a substantially circumferential array so that the limb assemblies will hang generally downwardly from the attaching means and outwardly from the trunk member to define a truncated cone which is substantially coaxial with the trunk member. A frusto conical member is mounted within the truncated cone defined by the limb assemblies to provide a background for the branch assemblies, thereby creating the appearance of a thicker, fuller artificial tree.

DESCRIPTION OF THE INVENTION

Figure 1:
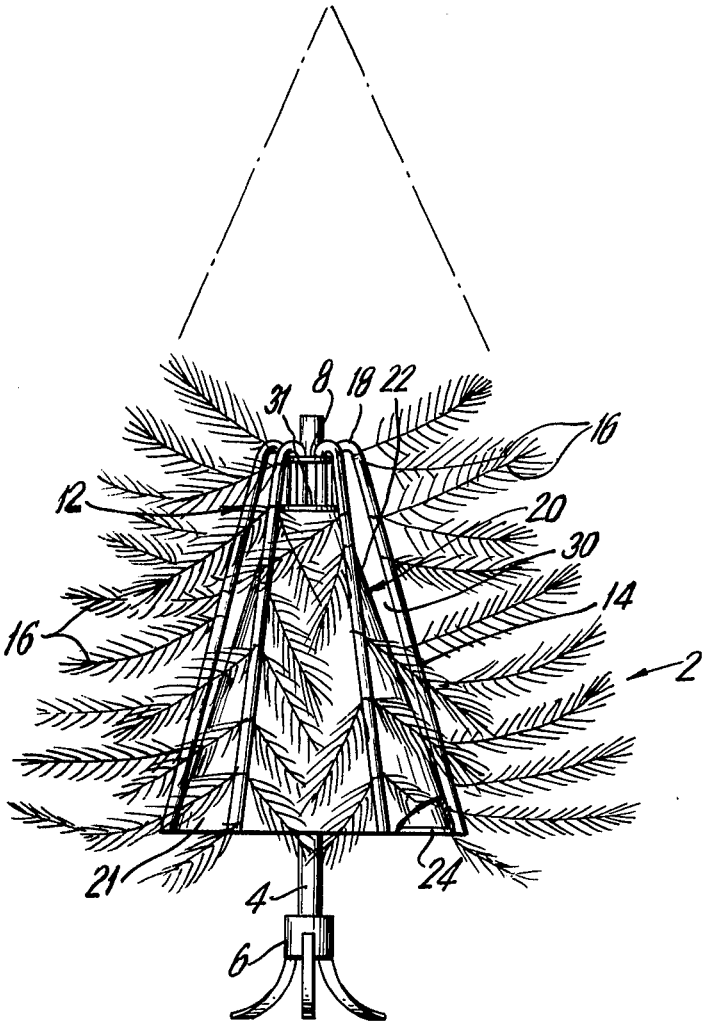
FIG. 1 is a frontal view of an artificial tree according to a first embodiment of this invention.

The artificial tree 2 as shown in FIG. 1 includes a cylindrical trunk member 4 which is held in a vertical position by a supporting stand 6. A branch holder 8 is mounted circumferentially around the cylindrical trunk member 4 at a point near the top. The branch holder 8 includes an outwardly extending flange 9 having a number of spaced circumferential aperatures 10.

Figure 2:
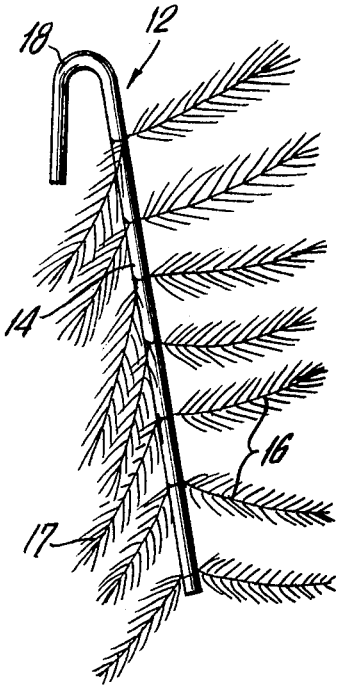
FIG. 2 is a detailed view of one of the limb assemblies of the artificial tree of FIG. 1.

A plurality of detachable branch assemblies 12 are provided, as shown in detail in FIG. 2. Each of the branch assemblies 12 includes a central main branch 14 and a number of smaller branches 16 which are attached to the main branch 14 and extend outwardly in a substantially transverse direction from the main branch 14 to simulate the appearance of a natural tree branch. Colored foliage 17, which for example may be plastic, is attached to the cross limbs 16 and can also be attached to the main limb 14 of the limb assembly 12. One end of the branch member 14 of the branch assemblies 12 is preferably free of foliage and is formed into a hook 18. This hook 18 is insertable through one of the apertures 10 in branch holder 8. When the hook 18 is inserted into an aperture 10 in the branch holder 8, the branch assembly 12 will hand downwardly along the trunk member 4. Depending on the arrangement of the hooked end 18 and the configuration of the branch assembly 12, the branch assembly will also extend outwardly at an angle from the trunk 4. When branch assemblies 12 are inserted into each of the circumferentially arranged apertures 10 of branch holder 8, a truncated conical tree structure is formed which closely simulates the appearance of a natural tree. As can best be seen in FIG. 1, the underside of branch assemblies 12 will define a truncated conical region 30 around the trunk 4 which is devoid of branches.

Figure 3:
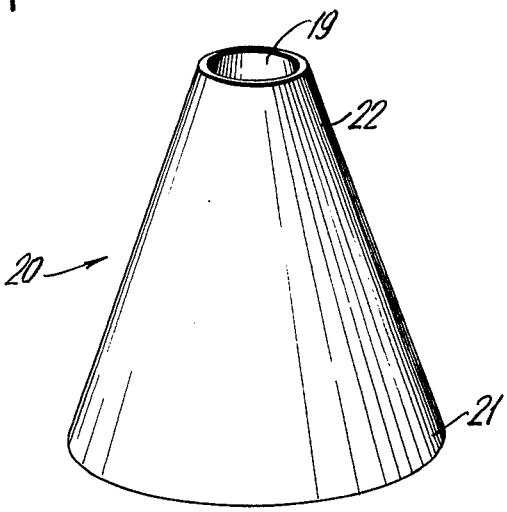
FIG. 3 is a detailed view of the frusto conical member of the embodiment shown in FIG. 1.

In order to enhance the appearance of the above type artificial tree, a frusto conical structure 20 of a color similar to that of the foliage 17 on the branch assemblies 12 is mounted within the area 30 between the underside of branch assemblies 12 and the trunk member 4. A flange 31 is attached to the trunk 4 below the branch holder flange 9 and extends radially outward from trunk 4. As can best be seen in FIG. 3, the smaller end 22 of the frusto conical structure 20 forms an aperture 19 which may be attached by glue or other fastening means about the periphery of th flange 31. The trunk member 4 will then extend through aperture 19 of the frusto conical member 20. If desired, flange 31 may include peripheral apertures 32 which are arranged so that hooked ends 18 of the branch assemblies 12 will extend through the apertures 32 to provide for more stability in the mounting of the branch assemblies 12.

When mounted the frusto conical member 20 will be substantially coaxial with the trunk member 4 and will extend downwardly along the trunk member and outwardly from the trunk member at an angle determined by the apex angle of the frusto conical member.

When branch assemblies 12 are attached to the branch holder 8 as described above, they will hang downwardly parabolically rather than extending downwardly at a uniform angle from the holder 8 because of their weight and flexibility. By contrast, the frusto conical assembly will extend outwardly at a constant angle; and if the angle at the apex of the frusto conical member is properly chosen, the branch assemblies 12 will intersect the sloping surface of the frusto conical member at a circle of points. The height of the frusto conical member and its apex angle can be chosen so that the branch assemblies 12 will contact the larger base end 21 of the frusto conical member at or near their end points, and the arrangement of FIG. 1 will result.

In this configuration the frusto conical member 20 will extend downwardly along and spaced slightly beneath the branch assemblies 12 gradually approaching and eventually intersecting the assemblies as described above. When looking at the tree 2 one will see through the foliage 17 on the branch assemblies 12 to the underlying solid frusto conical structure 20. Since the frusto conical structure 20 is substantially the same color as the foliage 17 on the branches, it blends with this foliage 17 to create the illusion of more branches and hence a thicker, fuller tree. The presence of the frusto conical structure 20 also eliminates the need to decorate that portion of the trunk member 4 which is covered by the frusto conical member 20.

The frusto conical member 20 may be made of relatively heavy material such as wood or metal so that the member will maintain its conical shape without the need for supporting structures. A frusto conical structure 20 made of such materials could also be utilized to provide support for the branch assemblies 12 thereby preventing the lower ends of the branch assemblies 12 from hanging too far inwardly toward the trunk 4 and insuring that the tree 2 will retain its desired shape.

Figure 4:
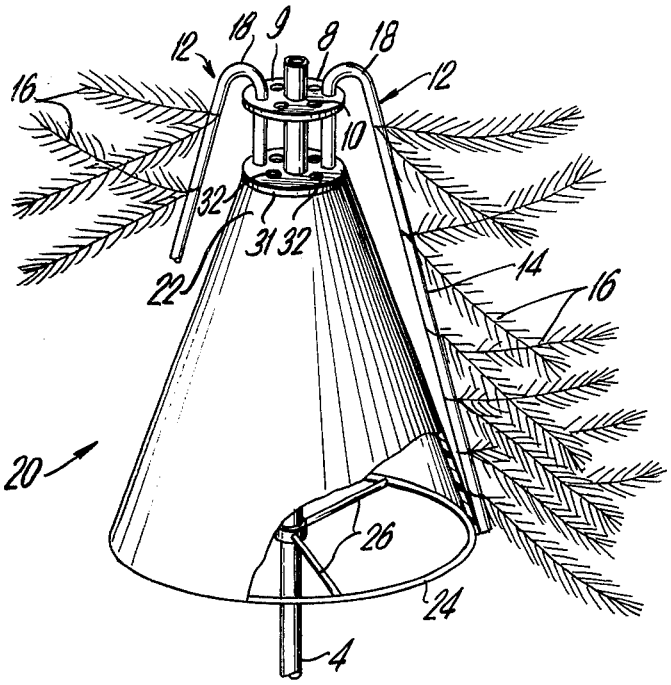
FIG. 4 is a partially cut away prospective view of a portion of the artificial tree of FIG. 1.

For some applications it is desirable to make the frusto conical structure 20 of flexible materials, such as a relatively thin sheet of plastic, which would not be selfsupporting. One advantage in making the frusto conical member 20 of a flexible material is that it can be folded to a convenient size for storage. In order to maintain a flexible sheet of plastic material in a frusto conical shape, a structure such as a ring 24 is circumferentially mounted about the trunk 4 so that the ring is spaced outwardly from the trunk 4 at a desired radial distance which is determined by the combination of the apex angle of the frusto conical structure 20 and the vertical height at which the frusto conical structure is to intersect the branch assemblies 12. Rodlike spokes 26 as seen in FIG. 4 can be used to attach the ring 24 to the trunk 4. The larger base end 21 of the frusto conical structure is then attached to the ring 24 by glue or other fastening means to provide the relatively stiff frusto conical structure 20 desired.

The support ring 24 is preferably arranged so that it supports the lower end 21 of the frusto conical structure 20 along the circle of points where the limb assemblies 12 bear against the frusto conical structure 20. In this way the support ring 24 can be used to provide support for the limb assemblies 12 maintaining them at a constant distance from said trunk to insure that the tree maintains a uniform shape.

Figure 5:
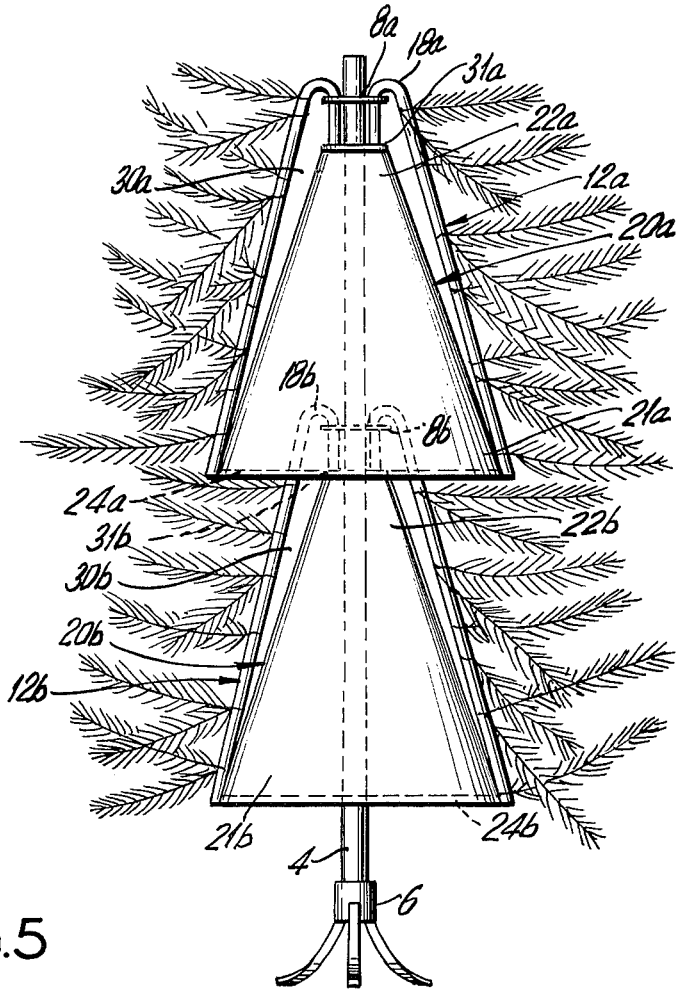
FIG. 5 is a frontal view of an artificial tree according to a second embodiment of this invention.

An artificial tree utilizing this invention can be made comprising several tiers, as shown in the embodiment of FIG. 5. Each of these tiers will then include branch holders, such as 8(*a*) and 8(*b*), which are mounted about predetermined points on the trunk member 4. Two groups of branch assemblies, such as 12(*a*) and 12(*b*), are suspended from the branch holders to form two branch assembly arrays circumferentially arranged about the central trunk 4 to define truncated conical regions 30(*a*) and 30(*b*) as more fully described above. The apex end 22(*a*) of a first frusto conical member 20(*a*) is attached to flange 31(*a*) and the base end 21(*a*) of first frusto conical member 20(*a*) is attached to a support ring 24(*a*). A second branch holder 8(*b*) is preferably mounted about the trunk 4 at a point which is within the truncated cone defined by the first array of branch assemblies 12(*a*). In this way the branch assemblies 12(*a*) and the first frusto conical member 20(*a*) overlap and conceal the second branch holder 8(*b*). The second array of branch assemblies 12(*b*) then extend from beneath the first array 12(*a*) to define a second truncated conical region 30(*b*). A second frusto conical member 20(*b*) is mounted within the second truncated conical region 30(*b*) by attaching the apex end 22(*b*) of the second frusto conical member 20(*b*) to flange 31(*b*) which is circumferentially attached to trunk 4. The base end 21(*b*) of the second frusto conical member 20(*b*) is attached to support ring 24(*b*). As can readily be seen, additional tiers can be added if desired.

What is claimed is:

1. An artificial shrub comprising:

a cylindrical trunk member having a central axis oriented in a substantially vertical direction;

a plurality of limb assemblies, each of said limb assemblies including a main limb having a hooked end and a number of cross limbs, said cross limbs being attached to said main limb;

a bracket mounted circumferentially about said trunk member at a first predetermined height, said bracket including an outwardly extending flange having a plurality of circumferential apertures, the hooked ends of said main limbs of said limb assemblies being insertable into said apertures so that said limb assemblies are suspended from said flange in a substantially circumferential array to define a substantially conical space;

a frusto conical member of a flexible material having an apex end and a base end;

second bracket means for attaching the apex end of said frusto conical member to said trunk member at a second predetermined height which is less than said first predetermined height such that said frusto conical member hangs downwardly from said second bracket means within said substantially conical space; and support means attached to said trunk member at a third predetermined height which is less than said second predetermined height, said support means including at least one support member having a first end which is attached to said trunk member and a second end which is radially spaced from said trunk member, and a ringlike member attached to the second end of said support member so that said ringlike member is mounted substantially coaxially with said trunk member to support the base end of said flexible frusto conical member a predetermined radial distance from said trunk member.

2. An artificial tree comprising:

a cylindrical trunk member with its axis generally oriented in a vertical direction;

a plurality of mounting means, each of said mounting means being arranged circumferentially about said trunk member at a predetermined vertical position;

a plurality of limb assemblies;

means to attach said limb assemblies in a circumferential array about each of said mounting means so that said limb assemblies hang from said mounting means generally downwardly and outwardly from said trunk member to form a circumferential array of limb assemblies about said trunk member, each of said arrays of limb assemblies defining a substantially conical space;

a plurality of frusto conical members;

a plurality of first attachment means for attaching the apex end of each of said frusto conical members to said trunk member within the upper portions of said spaces defined by each of said arrays of limb assemblies; and a plurality of second attachment means attached to and extending outwardly from said trunk member to support the base end of each of said frusto conical members within the lower portion of said spaces defined by each of said arrays of limb assemblies such that said frusto conical members are substantially coaxial with said trunk member.

* * * * *